US011359801B1

(12) United States Patent
Maglica

(10) Patent No.: US 11,359,801 B1
(45) Date of Patent: Jun. 14, 2022

(54) TACTICAL FLASHLIGHT WITH RAISED TACTICAL SWITCH AND SUPPORT HAND TACTICAL GRIP

(71) Applicant: Mag Instrument, Inc., Ontario, CA (US)

(72) Inventor: Anthony Maglica, Ontario, CA (US)

(73) Assignee: Mag Instrument, Inc., Ontario, CA (US)

( * ) Notice: Subject to any disclaimer, the term of this patent is extended or adjusted under 35 U.S.C. 154(b) by 0 days.

(21) Appl. No.: 16/660,712

(22) Filed: Oct. 22, 2019

(51) Int. Cl.
*F21V 15/01* (2006.01)
*F21V 23/04* (2006.01)

(52) U.S. Cl.
CPC ..... *F21V 23/0421* (2013.01); *F21V 15/01* (2013.01)

(58) Field of Classification Search
None
See application file for complete search history.

(56) References Cited

U.S. PATENT DOCUMENTS 6,183,106 B1 * 2/2001 Thummel ..... F21L 4/00 362/188
6,227,678 B1 * 5/2001 Yau ..... F21L 4/005 362/202
7,278,764 B2 * 10/2007 Kim ..... F21V 21/0885 362/103
7,686,472 B1 * 3/2010 Huang ..... F21L 4/005 362/202
7,866,841 B2 * 1/2011 Bushee ..... F21V 33/0076
D724,247 S * 3/2015 Chouprinov ..... D22/117
9,324,218 B2 * 4/2016 Stewart ..... G08B 7/00
10,041,635 B2 * 8/2018 Lam ..... F21V 7/0075
2006/0164824 A1 * 7/2006 Kim ..... F21V 33/0064 362/119
2007/0258236 A1 * 11/2007 Miller ..... F21L 4/027 362/205
2008/0205037 A1 * 8/2008 Griffin ..... F41G 11/003 362/110
2008/0291666 A1 * 11/2008 Bushee ..... F21V 33/0076 362/206
2008/0291667 A1 * 11/2008 Bushee ..... F41B 15/08 362/206
2010/0315805 A1 * 12/2010 Dongpan ..... F21V 5/006 362/157
2011/0182062 A1 * 7/2011 Wilson ..... F21V 15/04 362/197
2013/0049582 A1 * 2/2013 West ..... H05B 45/375 315/33
2014/0000145 A1 * 1/2014 Merritt ..... F41F 1/00 42/114
2016/0033091 A1 * 2/2016 Sharrah ..... F21V 15/01 362/202

* cited by examiner

*Primary Examiner* — Elmito Breval
(74) *Attorney, Agent, or Firm* — Roy L. Anderson

(57) ABSTRACT

A tactical flashlight with a raised tactical switch and a support hand tactical grip integrally formed with the flashlight barrel to provide multiple gripping positions for use in a flashlight shooting technique where the thenar of a user can be used to turn the flashlight on/off.

9 Claims, 8 Drawing Sheets

TACTICAL FLASHLIGHT WITH RAISED TACTICAL SWITCH AND SUPPORT HAND TACTICAL GRIP

FIELD OF THE INVENTION

The field of the present invention is flashlights and, more particularly, flashlights that are used by law enforcement and military personnel for tactical purposes.

BACKGROUND OF THE INVENTION

Tactical flashlights for police and military use in low-light conditions are well known. It is also well known that such flashlights can be used with various techniques for shooting a handgun.

SUMMARY OF THE INVENTION

The present invention is generally directed to a tactical flashlight, and a method of using it, having a raised tactical switch and a support hand tactical grip integrally formed with the flashlight barrel. The raised tactical switch uses an on/off switch and stabilizing means (such as three stability bumps) for allowing the tactical flashlight to be supported on a flat surface without causing the on/off switch to change states. The raised tactical switch is configured to allow a thenar of a user to actuate the on/off switch in a flashlight shooting technique. The support hand tactical grip uses at least one (and preferably two) finger ridge(s) not proximate to the raised tactical switch to provide multiple gripping positions.

Accordingly, it is a primary object of the present invention to provide a tactical flashlight which provides an improved tactical advantage when used in a flashlight shooting technique.

This and further objects and advantages will be apparent to those skilled in the art in connection with the detailed description set forth below.

DETAILED DESCRIPTION OF THE INVENTION

Tactical flashlights are important tools for use by law enforcement and military personnel in low-light conditions.

An example of such a flashlight, which is rechargeable, is set forth in U.S. Pat. No. 9,671,098, the disclosure of which is specifically incorporated herein in its entirety.

The present invention is applicable to flashlights which use rechargeable batteries, but it is not limited to such flashlights, and is also applicable to flashlights that do not use rechargeable batteries.

Unlike flashlights disclosed in U.S. Pat. No. 9,671,098, or tactical flashlights sold under the trademark Mag-Tac®, in accordance with an especially preferred embodiment of the present invention, tactical flashlight 1 has a raised tactical switch and a support hand tactical grip.

Figure 1:
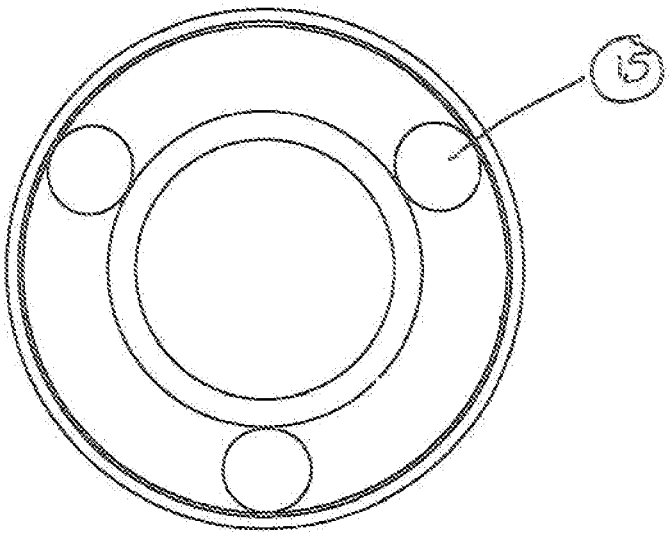
FIG. 1 illustrates a top plan view of a raised tactical switch of a tactical flashlight in accordance with the present invention.
Figure 4:
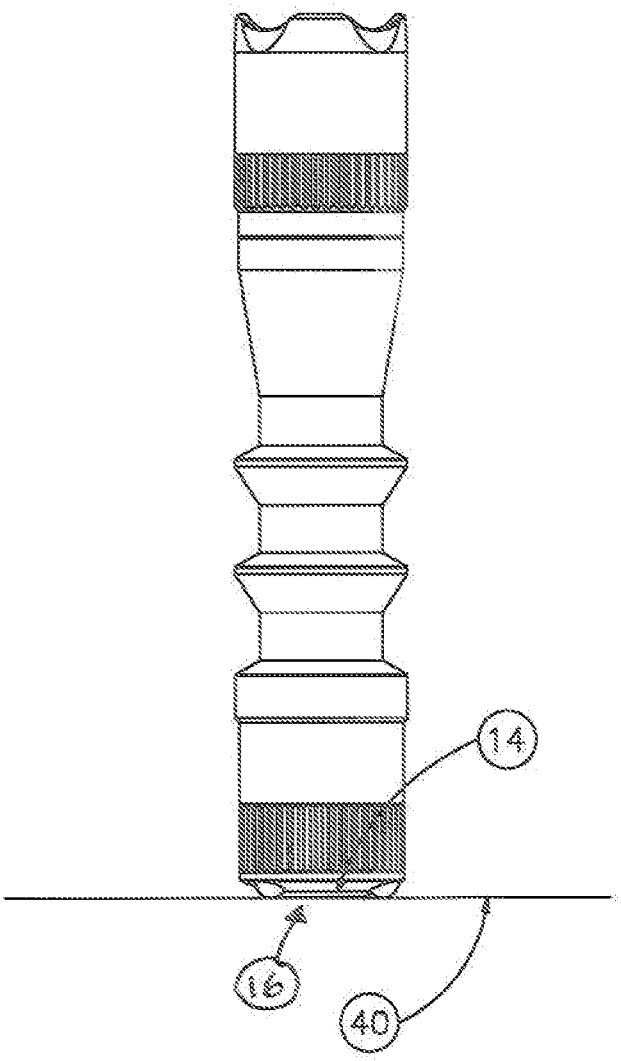
FIG. 4 illustrates a side profile view of the tactical flashlight of FIG. 1 sitting on a flat surface.
Figure 5:
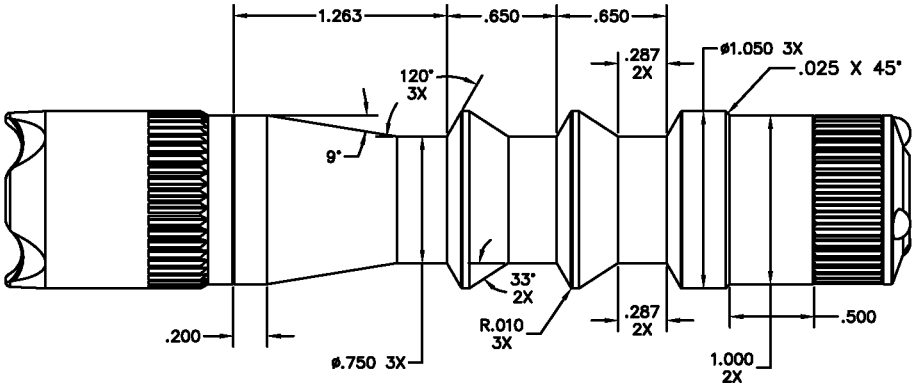
FIG. 5 illustrates a side profile view of the tactical flashlight of FIG. 1 having an alternative aesthetic design of a support hand tactical grip in accordance with the present invention.

A raised tactical switch, generally designated as 11, is located at tail cap end 3 of flashlight barrel 2 opposite from light-emitting end 4 of barrel 2. Raised tactical switch 11 includes a switch assembly 12 configured within tail cap 13 having an external surface 14 (which can be a switch port seal as is disclosed as 168 in U.S. Pat. No. 9,671,098) and switch assembly stabilizing means for allowing the tactical flashlight to be supported on a flat surface 40 (as illustrated in FIG. 4) without causing switch assembly 12 to change states, such as changing between on and off. An especially preferred embodiment of the stabilizing means is to position three stability bumps 1 on tail cap 13 as is illustrated in FIG. 1. Stability bumps 15 should be designed and sized so that they will stably support tactical flashlight 1 while also allowing the soft part of the hand at the base of the thumb (the thenar) to actuate switch assembly 12 to cause it to change states (e.g., on/off, or any other state changes allowed by the switch assembly) when tactical flashlight 1 is being used in a flashlight shooting technique. Such actuation is particularly useful while accidental actuation is minimized by ensuring stability bumps 15 extend farther away from the tail cap than switch assembly 12 so that switch assembly 12 does not contact flat surface 40 when tactical flashlight 1 is supported on the flat surface and there are gaps 16 located between stability bumps 15 and switch assembly 12.

Figure 2:
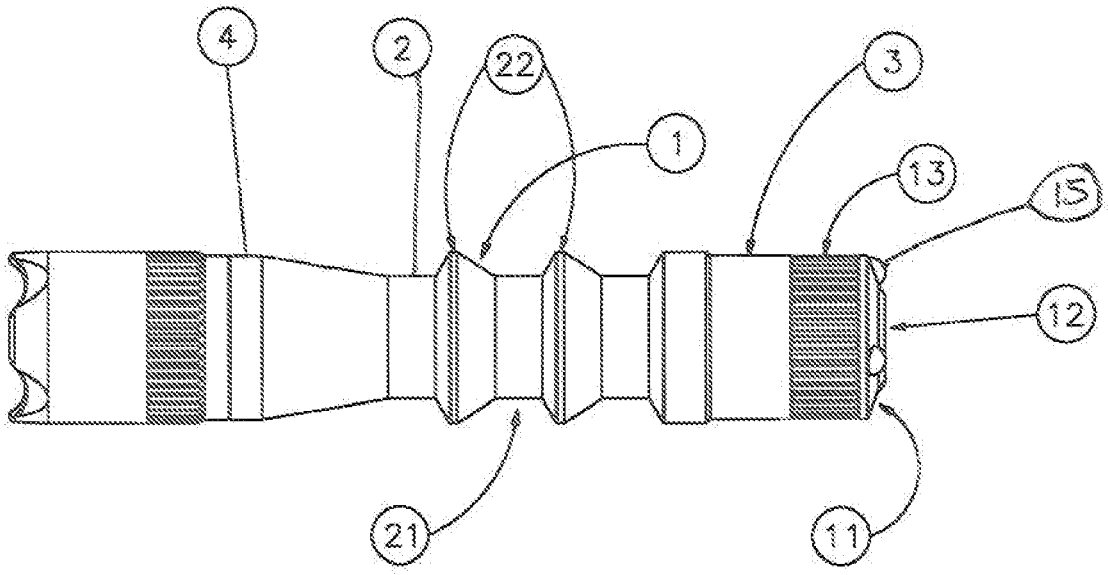
FIG. 2 illustrates a side profile view of the tactical flashlight of FIG. 1.
Figure 3:
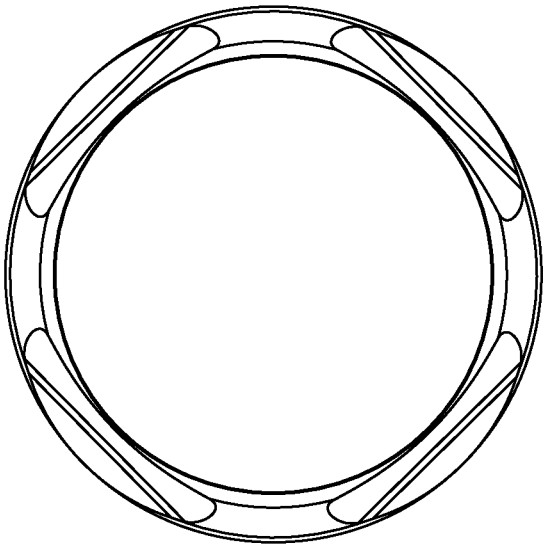
FIG. 3 illustrates a top plan view of a light-emitting end of the tactical flashlight of FIG. 1.
Figure 6:
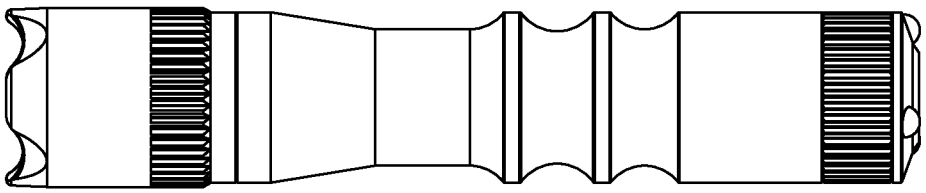
FIG. 6 illustrates the measurements provided in Table 1 from the tactical flashlight illustrated in FIG. 2.
Figure 7:
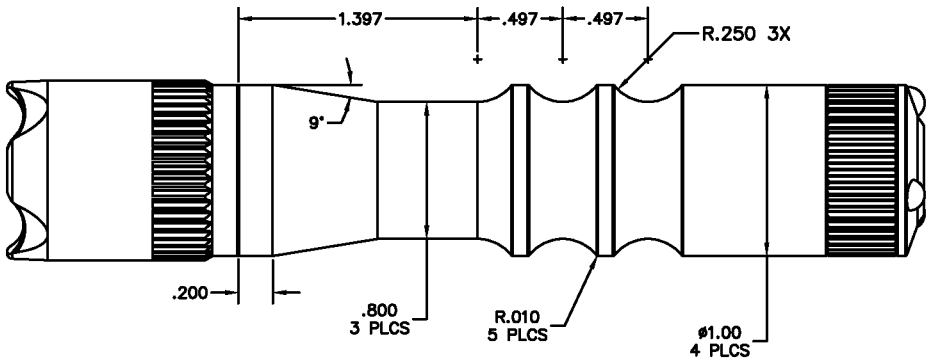
FIG. 7 illustrates the measurements provided in Table 2 from the tactical flashlight illustrated in FIG. 5.
Figure 8:
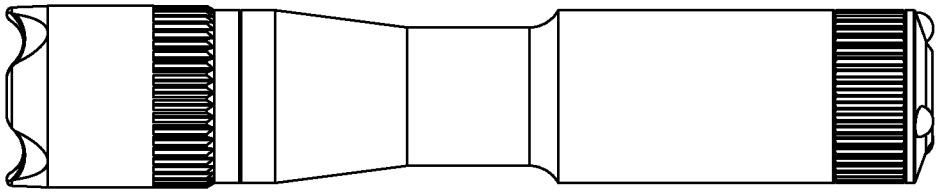
FIG. 8 illustrates a side profile of the tactical flashlight of FIG. 1 having an alternative aesthetic design of a support hand tactical grip in accordance with the present invention.

A support hand tactical grip, generally designated as 21, is integrally formed in barrel 2 by configuring at least one (see FIG. 8), and preferably two (see FIGS. 2 and 6), finger ridges in barrel 2. It is especially preferred that finger ridges 22 are not proximate to raised tactical switch 11 and that they have substantially the same outer diameter as tailcap end 3 and light-emitting end 4 of barrel 2, which means that the diameter of barrel 2 will be less moving off of finger ridges 22 so that the flashlight barrel will have a smaller diameter where the index and middle fingers grip the flashlight which is important for flashlight control and ergonomic function (i.e., less muscle strain and fatigue). To better illustrate such concepts, and without intending to limit the scope of the invention, two especially preferred embodiments of the invention can be manufactured having the measurements marked, respectively, in FIGS. 6 and 7, which are drawn to scale:

It is especially preferred to have two or more finger ridges 22 so that they can be configured to provide multiple gripping positions. This allows a user of the tactical flashlight to adjust his or her grip of the flashlight based upon hand size and whether or not a glove is being worn. In this regard, it is especially preferred that two finger ridges 22 are configured so that the spacing between them allows a gloved finger to grip the barrel between the two finger ridges while the reduced barrel diameter between the two finger ridges is preferably chosen to optimize ergonomic and control considerations. Note that FIGS. 2 and 6 illustrate differing styles of finger ridges 22, and other styles are clearly within the intended scope of the present invention, the exact nature of such styles being dependent upon ergonomic and aesthetic choice. It is especially preferred that finger ridges 22 not be proximate to raised tactical switch 11 to promote stability and provide extra support for a flashlight shooting technique.

The present invention represents a significant improvement in tactical flashlights useful in a flashlight shooting technique by providing enhanced weapon and light control and ergonomic design. Use of a tactical flashlight in accordance with the present invention will be more stable and allow extra support for the shooting hand, be less fatiguing (because there is no need to rely upon muscle energy to hold a position through constant pressure and a user only needs to apply pressure when needed to turn the flashlight on or off) and provide repeatability of results (because the finger ridges do not move).

While the invention has been described herein with reference to certain preferred embodiments, those embodiments have been presented by way of example only, and not to limit the scope of the invention. Additional embodiments thereof will be obvious to those skilled in the art having the benefit of this detailed description.

Accordingly, it will be apparent to those skilled in the art that still further changes and modifications in the actual concepts described herein can readily be made without departing from the spirit and scope of the disclosed inventions.

What is claimed is:

1. A tactical flashlight, comprising:

a flashlight barrel with a first outer diameter;

a light-emitting end of the flashlight barrel;

a support hand tactical grip comprised of at least one finger ridge configured to provide a gripping position, said finger ridge being integrally formed with the flashlight barrel with an outer ridge diameter which is greater than the first outer diameter; and a tactical switch located at a tailcap end of the flashlight barrel opposite from the light-emitting end of the flashlight, wherein said tactical switch is comprised of:

a switch assembly configured to change between at least two operating states of the tactical flashlight;

a plurality of supports configured to allow the tactical flashlight to be supported on a flat surface without causing the switch assembly to change states; and a plurality of access openings configured between the plurality of supports to allow a thenar of a user of the tactical flashlight to access the switch assembly and cause it to change states when the user is using the tactical flashlight in a flashlight shooting technique;

wherein the tactical switch has a second outer diameter which is greater than the first outer diameter.

2. The tactical flashlight of claim 1, wherein the support hand tactical grip is comprised of a plurality of finger ridges configured to provide a plurality of gripping positions.

3. The tactical flashlight of claim 1, wherein the plurality of supports extend farther away from the flashlight barrel than the switch assembly.

4. The tactical flashlight of claim 3, wherein the plurality of supports is comprised of at least three stability bumps.

5. A tactical flashlight, comprising:

a flashlight barrel with a first outer diameter;

a light-emitting end of the flashlight barrel;

a support hand tactical grip comprised of at least one finger ridge configured to provide a gripping position, said finger ridge being integrally formed with the flashlight barrel with an outer ridge diameter which is greater than the first outer diameter; and a tactical switch located at a tailcap end of the flashlight barrel opposite from the light-emitting end of the flashlight, wherein said tactical switch is comprised of:

a switch assembly configured to change between at least two operating states of the tactical flashlight;

a plurality of supports configured to allow the tactical flashlight to be supported on a flat surface without causing the switch assembly to change states; and a plurality of access openings configured between the plurality of supports to allow a thenar of a user of the tactical flashlight to access the switch assembly and cause it to change states when the user is using the tactical flashlight in a flashlight shooting technique;

wherein the plurality of supports is comprised of at least three stability bumps.

6. A tactical flashlight, comprising:

a flashlight barrel with a first outer diameter;

a light-emitting end of the flashlight barrel;

a support hand tactical grip comprised of at least one finger ridge configured to provide a gripping position, said finger ridge being integrally formed with the flashlight barrel with an outer ridge diameter which is greater than the first outer diameter; and a tactical switch located at a tailcap end of the flashlight barrel opposite from the light-emitting end of the flashlight, wherein said tactical switch is comprised of:

a switch assembly configured to change between at least two operating states of the tactical flashlight;

a plurality of supports configured to allow the tactical flashlight to be supported on a flat surface in a generally upright position in which the tailcap end is more proximate to the flat surface than the light-emitting end of the flashlight without causing the switch assembly to change states; and a plurality of access openings configured between the plurality of supports to allow a thenar of a user of the tactical flashlight to access the switch assembly and cause it to change states when the user is using the tactical flashlight in a flashlight shooting technique, wherein the plurality of supports extend farther away from the tailcap end of the flashlight barrel than the switch assembly and the plurality of access openings allow the thenar of the user to access the switch assembly from a direction which is not generally perpendicular to a plane configured as a cross section of the flashlight barrel formed at right angles to an axis of the barrel.

7. The tactical flashlight of claim 6, wherein the support hand tactical grip is comprised of a plurality of finger ridges configured to provide a plurality of gripping positions.

8. The tactical flashlight of claim 6, wherein the plurality of supports extend farther away from the flashlight barrel than the switch assembly.

9. The tactical flashlight of claim 8, wherein the plurality of supports is comprised of at least three stability bumps.

* * * * *